United States Patent [19]

Jugle et al.

[11] 4,058,086

[45] Nov. 15, 1977

[54] EMISSION CONTROLLER FOR DEVELOPMENT APPARATUS

[75] Inventors: Don B. Jugle, Penfield; Anthony F. Lipani, Webster, both of N.Y.

[73] Assignee: Xerox Corporation, Stamford, Conn.

[21] Appl. No.: 685,216

[22] Filed: May 11, 1976

[51] Int. Cl.[2] ..... G03G 15/08

[52] U.S. Cl. ..... 118/653; 118/655; 355/15

[58] Field of Search ..... 118/653, 654, 655, 656, 118/657, 658; 355/3 R, 3 DD, 15, 17; 15/1.5; 96/1.5 D; 209/295, 321, 399, 405

[56] References Cited

U.S. PATENT DOCUMENTS

| | | | |
|---|---|---|---|
| 3,038,442 | 6/1962 | Jones et al. | 118/653 |
| 3,894,514 | 7/1975 | Caudill et al. | 118/655 |
| 3,909,864 | 10/1975 | Tanaka et al. | 15/1.5 |
| 3,914,046 | 10/1975 | Tanaka et al. | 355/15 |

*Primary Examiner*—Henry S. Jaudon

[57] ABSTRACT

A system for minimizing free airborne particles generated by movement of a multi-component developer material within a development housing of an electrostatographic machine. The multi-component material includes a relatively large carrier component and a relatively small toner component for developing electrostatographic images. A filter member with predetermined pore size is positioned across the flow of the multi-component material and connected to a source of negative pressure.

2 Claims, 4 Drawing Figures

EMISSION CONTROLLER FOR DEVELOPMENT APPARATUS

BACKGROUND OF THE INVENTION

This invention relates to emission control apparatus for use in the control of airborne particles separated from a two component powder which has been agitated in a partially open container as, for example, the development system of an electrostatographic processor.

In a conventional electrostatographic printing process of the type described in Carlson's U.S. Pat. No. 2,297,691 on "Electrophotography", a uniformly charged imaging surface is selectively discharged in an image configuration, thereby forming a latent electrostatic image. That image is then developed by applying a finely divided, electroscopic coloring material, called "toner", to the imaging surface.

Sometimes the process is carried out in a "non-transfer mode", meaning that the imaging surface serves as the ultimate substrate for the toned or developed image. Favored, however, is a "transfer mode" in which the developed image is transferred to a separate substrate, such as plain paper, so that the imaging surface may be reused after any residual toner has been removed therefrom. Indeed electrostatographic printing has enjoyed outstanding commercial success, especially in plain paper xerographic copiers and duplicators.

One of the common characteristics of the electrostatographic printing process is the development step. Modern processors generally carry out that step on the fly - viz. as the imaging surface moves through a development zone. To accomplish that, they normally include a cascade or a magnetic brush development system for circulating a two component developer material along a path running from a sump, through the development zone, and then back to the sump.

Briefly, the developer used in such a development system is basically a dry mixture of toner particles with or without fine additives to the toner and larger, so-called "carrier" particles as described, for example, in U.S. Pat. Nos. 3,590,000, 3,819,367, and 3,900,588. In practice, the materials for the toner and carrier (or sometimes, carrier coating) components of the mixture are selected from different positions in the triboelectric series so that electrical charges of opposite polarities tend to be imparted to the toner and carrier particles when the developer components are blended together. Moreover, in making those selections, consideration is given to the relative triboelectric ranking of the materials to the end that the polarity of the normal charge for the toner particles opposes the polarity of the latent images which are to be developed. Consequently, in operation, there are competing electrostatic forces acting on the toner particles. Specifically, one set of forces tend to attract them to the carrier particles while another set of forces tends to electrostatically strip them from that portion of the developer which is brought into the immediate proximity of or actuate contact with the image bearing surface.

An electrostatographic processor configured to operate in the transfer mode additionally includes a cleaning system for removing residual toner from the imaging surface after the developed image has been transferred to, say, plain paper. Again, modern processors usually carry out the step on the fly - viz., as the imaging surface moves through a cleaning zone. For that reason, such processors typically include a cleaning blade, brush or web for mechanically removing any residual toner which may tend to adhere to the imaging surface despite the transfer step.

Experience with toner handling subsystems of the aforementioned type has demonstrated that such systems often are sources of uncontrolled and undesired emissions of toner. It is known that the principal cause of that problem is the free toner which is captured in a suspended state and blown about by the air currents to which those systems are subjected. Prior attempts in solving this problem by a controlled air flow as described for example in U.S. Pat. Nos. 3,685,485 and 3,909,864 have not been entirely successful due to the poor prefiltration through baffles and the necessity to change filters frequently. The instant invention utilizes an improved toner emissioner control system and is specifically an improvement over copending application Ser. No. 597,129 filed on July 18, 1975, and commonly assigned herewith.

Accordingly, a primary object of the present invention is to provide an improved electrostatographic reproduction system capable of suppressing undesired emissions of airborne particles from agitated multi-component powders in a partially open container.

Another object of the invention is to provide a simple and reliable toner emission control technique for recombining airborne toner particles with a two component developer material composed of toner and carrier particles in a xerographic type development apparatus.

Still another object of the invention is to ensure continuous prefiltering of moving airborne particles generated by development apparatus.

Still further objects and advantages of this invention will become apparent when the following detailed description is read in conjunction with the attached drawings in which.

While the invention is described in some detail herein below with specific reference to certain illustrated embodiments, it is to be understood that there is no intent to limit it to those embodiments. For example, although the above describes the use of the invention in an electrostatographic processor, it is easily seen that invention is applicable to such diverse fields of endeavor as the storage and transport of grain in grain elevators and the transport of coal in chutes. In fact the invention is applicable whenever there is a possibility of a two component system consisting of large particles and small dust-like particles. The aim is to cover all modifications, alternatives, and equivalents falling within the spirit and scope of the invention as defined by the appended claims.

Figure 1:
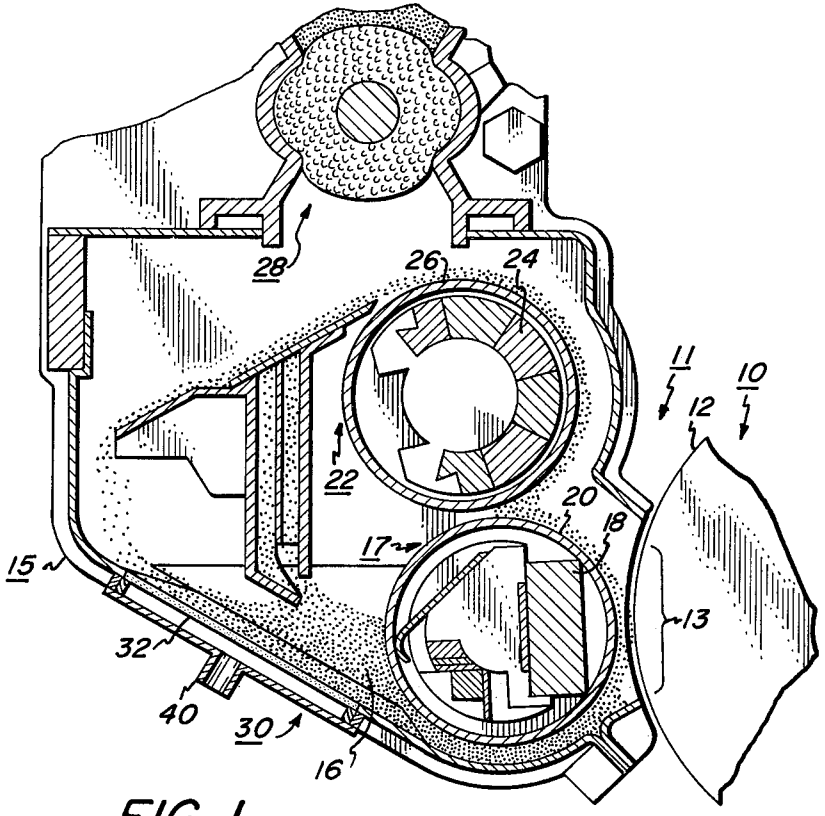
FIG. 1 is a simplified sectional view of a magnetic brush development apparatus for an electrostatographic copier machine having a toner emission control system in accordance with the present invention.
Figure 2:
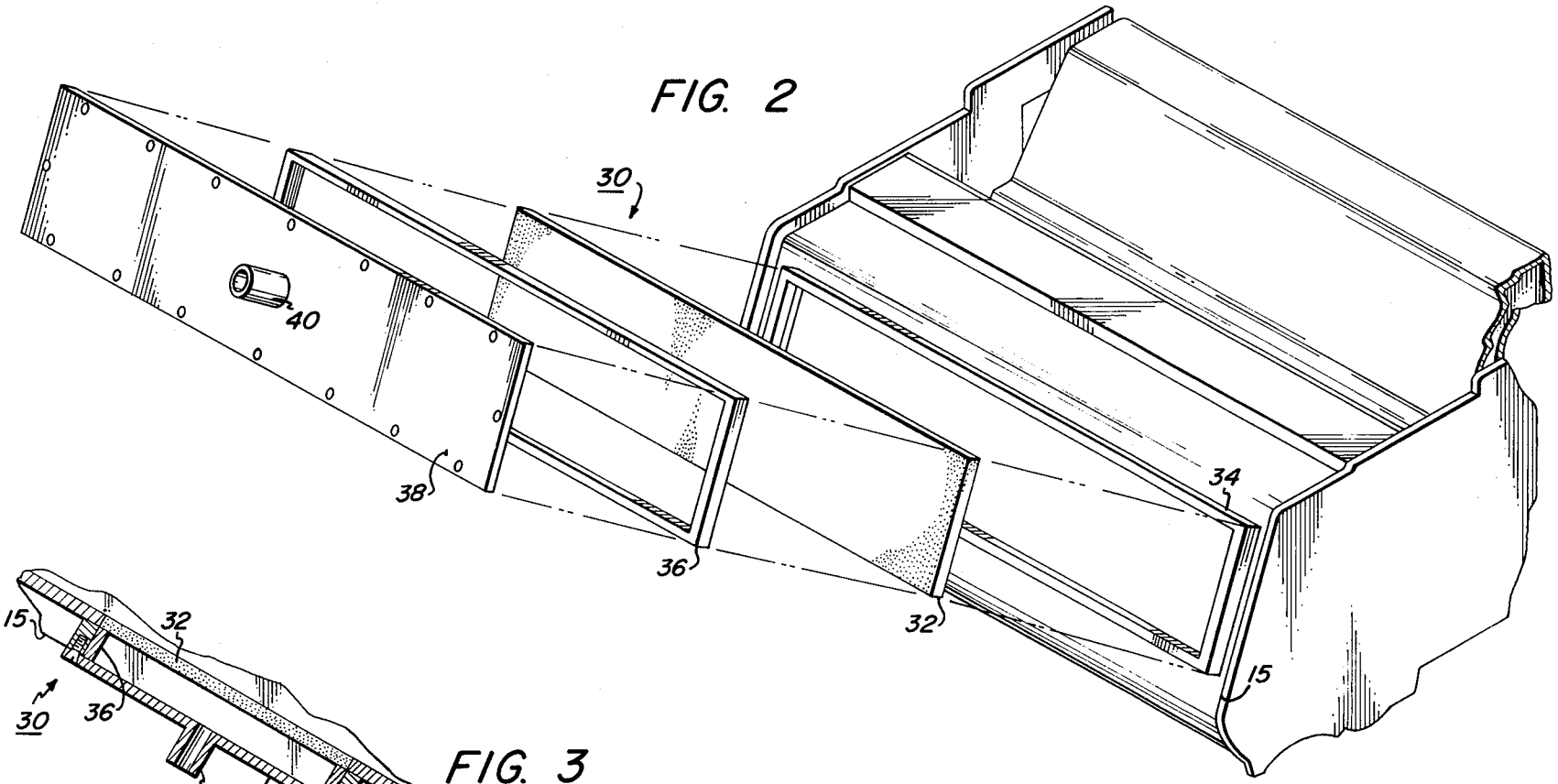
FIG. 2 is an exploded isometric view of the filter apparatus of the toner emission control system.
Figure 3:
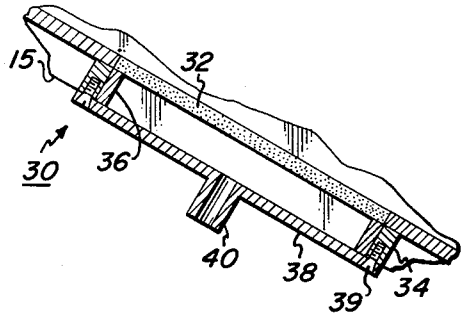
FIG. 3 is a partial sectional view of the construction of the filter apparatus.

Turning now to FIGS. 1 - 3 it will be seen that in FIG. 1 there is an electrostatographic processor 10 (shown only in relevant part) having a magnetic brush development system 11 for developing latent electrostatic images carried by an imaging surface 12 on the fly - viz., as the imaging surface 12 moves through a development zone 13. In this instance, the processor 10 is a generally conventional drum-type xerographic unit having a photoconductive imaging surface coated on a rotatably driven drum. Of course, that is just one example of a suitable processor configuration.

In keeping with standard practices, the development system 11 has a housing 15 which contains a sump 16 for storing a supply of developer (i.e., a dry mixture of toner particles and ferromagnetic carrier particles). Mounted within the housing 15 there is a developer roll assembly 17 for developing the latent electrostatic images on the imaging surface 12. To that end, roll assembly 17 typically comprises a permanent magnet assembly 18 which is stationarily supported within a rotatably driven, non-magnetic sleeve 20. A transport roll assembly 22 for circulating the developer material within the housing includes magnet assembly 24 and sleeve 26. In operation developer roll assembly 17 conveys the developer through the development zone 13 under the influence of a magnetic field which is shaped of streamers as it passes through the nips between the imaging surface 12 and the rolls 17. The streamers brush against the image surface image surface 12, thereby providing a ready source of toner for developing any latent images which happen to be present. Thereafter, the used or partially denuded developer is returned to the sump 16 by the action of transport roll assembly 22.

Some toner is necessarily consumed in the development process. Therefore, provision is conventionally made for adding additional toner from time to time by dispensing assembly 28 thereby maintaining the toner concentration of the developer at a suitably high level. Transport roll assembly 22 serves to maintain a reasonably uniform distribution of the available toner and to promote the triboelectric charging of the toner and carrier particles.

The carrier particles of most developer mixtures have sufficient weight to be substantially insensitive to the air currents which are generated in the ordinary course by the motion of the imaging surface and of other components of the processor, including the moving parts of the development zone. Unfortunately, the same cannot be said for the toner particles. Instead, those particles usually are so light that they are easily captured by the ordinary air currents, unless they are mechanically or electrostatically associated with the heavier host, such as the carrier particles. Consequently, free toner particles (i.e., those which are not associated with a suitable host) tend to become airborne when exposed to the air currents and are therefore likely to lead to unwanted toner emissions.

In accordance with this invention, a filter apparatus 30 is provided in the developer housing 15 to ensure airborne toner is prevented from leaving the housing and, thus, recombined with the developer material. Filter apparatus 30 includes a filter member 32 which is received by a filter holder rectangular frame 34 formed in the housing 15 as best shown in FIG. 3. A gasket member 36 made of any suitable material, such as, aluminum is positioned over the filter member which is held in place by a cover 38 with screws 39 received in frame 34. By this structure the filter member is flush with the sump wall. Cover 38 is formed with air nipple 40 which is connected to a vacuum source to maintain a slight negative pressure or vacuum on the housing 15, thereby drawing the airborne toner particles away from the imaging surface 12 and towards the filter member. The negative pressure or vacuum level is selected so that it does not disturb the carrier particles but does ensure that there is no significant flow of air out of the housing 15.

Filter member 32 is made from any suitable relatively rigid inert material which will not chemically react with toner. Suitable materials are sintered glass, plastic or metal. Preferred materials are polyethylene and stainless steel. The pores in the filter member have a pore size such that the typical airborne toner particles which are not recombined with the developer material are greater in size than the pores. Typically the pore size ranges from about 10 to about 500 microns and preferably from about 20 to about 100 microns. It has been found that the air velocity into the filter should not exceed 4 feet per minute to prevent particles from migrating into the filter member. Optimum air velocity is about 3.1 feet per minute for a filter member 1.625 inches wide by 12 inches long by 0.125 inches thick.

By this structure the developer material which flows acts as a prefiltering device, reducing the filtration necessary by filter member 32. Moreover, the flowing developer serves to clean and scavenge the toner particles from the filter member. The emission control of airborne toner works well because most of the airborne toner particles are sufficiently large due to a low charge-to-mass ratio yet, they have sufficient charge to be attracted to the carrier when brought in contact with it. Thus, there is both a physical and electrostatic attraction of the small and large particles.

Figure 4:
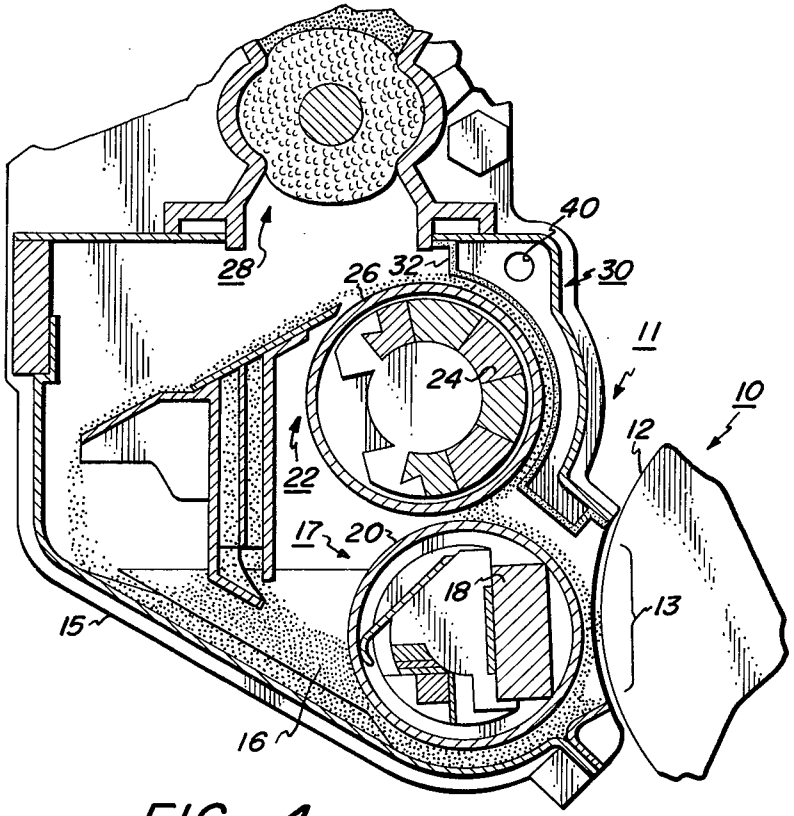
FIG. 4 is a view similar to FIG. 1 showing an alternative embodiment of the position of the filter apparatus.

FIG. 4 shows an alternative embodiment similar to FIG. 1 in which the filter apparatus 30 is arranged in the vicinity of the transport roll assembly 22. It will be appreciated that still other embodiments of the invention could be used such as a filter member in a cylindrical form as shownm for example, by sleeves 20 and 26.

Above is described a simple but effective system for suppressing unwanted emissions of airborne toner particles separated from a two component developer material which has been agitated in the housing of a magnetic development unit of an electrostatographic machine.

While the invention has been described with reference to the structure disclosed, it is not confined to the details set forth, but is intended to cover such modifications or changes as may come within the scope of the following claims.

What is claimed is:

1. In an electrostatographic reproduction system in which a latent electrostatic image is developed by a multi-component developer material including toner particles and relatively larger carrier particles an improved emission control apparatus for suppressing airborne toner particles comprising a developer housing having a sump containing multi-component developer material, said multi-component developer material including toner particles and relatively larger carrier particles, means for applying said developer material to develop latent electrostatic images and cause at least a portion of said toner particles to become airborne, filter means positioned in said housing flush with the sump thereof in the flow path of said developer material to effect continuous cleaning thereof, said filter means including a filter member having a pore size ranging from about 20 microns to about 100 microns, said filter means being connected to a source of negative pressure to cause airborne particles to move in the direction of said filter member at a predetermined rate whereby said airborne particles combine with the flowing developer material for prefiltering thereby prior to reaching said filter member.

2. Apparatus according to claim 1 wherein said negative pressure is such that the air velocity into said filter member is about 4 feet per minute.

* * * * *